United States Patent [19]

Read

[11] Patent Number: 4,749,036

[45] Date of Patent: Jun. 7, 1988

[54] DUAL BORE WELL TREATING TOOL

[75] Inventor: Norman W. Read, Dallas, Tex.

[73] Assignee: Dresser Industries, Inc., Dallas, Tex.

[21] Appl. No.: 915,478

[22] Filed: Oct. 6, 1986

[51] Int. Cl.[4] ..... E21B 23/06; E21B 34/10; F16K 11/16

[52] U.S. Cl. ..... 166/143; 166/148; 166/182; 166/189; 166/902; 137/629; 137/630.19

[58] Field of Search ..... 166/123, 127, 143, 148, 166/151, 181, 182, 189, 191, 902; 251/160, 94; 137/628, 629, 630.19

[56] References Cited

U.S. PATENT DOCUMENTS

| | | | |
|---|---|---|---|
| Re. 28,588 | 10/1975 | Sizer et al. | 166/321 |
| 3,007,669 | 11/1961 | Fredd | 251/31 |
| 3,741,249 | 6/1973 | Leutwyler | 137/629 |
| 4,140,153 | 2/1979 | Deaton | 137/629 |
| 4,508,173 | 4/1985 | Read | 166/330 |
| 4,523,643 | 6/1985 | McGlothen | 166/297 |
| 4,637,460 | 1/1987 | McGlothen et al. | 166/191 |

*Primary Examiner*—Stephen J. Novosad
*Assistant Examiner*—Terry Lee Melius
*Attorney, Agent, or Firm*—Roy L. Van Winkle

[57] ABSTRACT

A dual bore well treating tool having a pressure operated valve therein that is useful in conjunction with a dual bore packer and with a dual bore on and off or connection tool. One of the bores through the on/off tool, the treating tool and the packer is utilized for producing oil and/or gas from the well bore, and a second bore is utilized for opening the valve and for simultaneously injecting a treating material into the fluid being produced.

10 Claims, 4 Drawing Sheets

DUAL BORE WELL TREATING TOOL

BACKGROUND OF THE INVENTION

This invention relates generally to improved well treating apparatus. More particularly, but not by way of limitation, this invention relates to an improved dual bore tool wherein a well can be produced and treated simultaneously and wherein the well can be selectively shut in.

Occasionally in the completion or the production of oil and gas wells and the like, it is desirable to be able to produce the well while at the same time injecting some type of treating material, such as a corrosion inhibitor, into the well simultaneously with the production. Tools are available which permit such simultaneous production and treatment to occur.

A packer or packers are generally set in the well bore to isolate the production zone from remaining portions of the well bore. Apparatus is known which provides means for leaving the packer in the well and for connecting various types of treating tools thereto.

If the production zone has high pressure therein or it is desirable for other reasons to shut in the production when disconnecting production tubing from the packer, a valve arrangement must be provided to perform this process. Valves of this type constructed in the past were not believed to be capable of permitting simultaneous production and treating operations to be carried on through the apparatus.

Accordingly, it is an object of this invention to provide an improved well treating apparatus that permits setting of a production packer with dual flow passageways in the well with a pressure actuated valve connected therewith which also has dual flow passageways therethrough. The apparatus also includes a selectively connectable and releasable dual bore connection tool attachment to the packer and valve whereby production tubing extending to the surface of the well can be connected to the apparatus and maintain the integrity of the separate flow passageways therethrough. The well is automatically shut in when the tubing is disconnected.

SUMMARY OF THE INVENTION

This invention then provides apparatus for use in well bores and the like that comprises in combination a well packer that is arranged to be set in a well bore and a packer having generally concentric bores extending therethrough. Valve means is connected to the packer that includes an elongated member having first and second passageways extending therethrough for connection with the concentric bores in the well packer. The valve means also includes a valve member pivotally located for opening and closing the first passageway. The valve means also includes valve operating means that is responsive to pressure in the second passageway for pivoting the valve member and has resilient means that urges the valve member toward one of the positions. Releasable connection means is provided that is arranged for connecting well tubing with the valve means and well packer with the passageways and bores providing separate fluid flow passageways therethrough.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
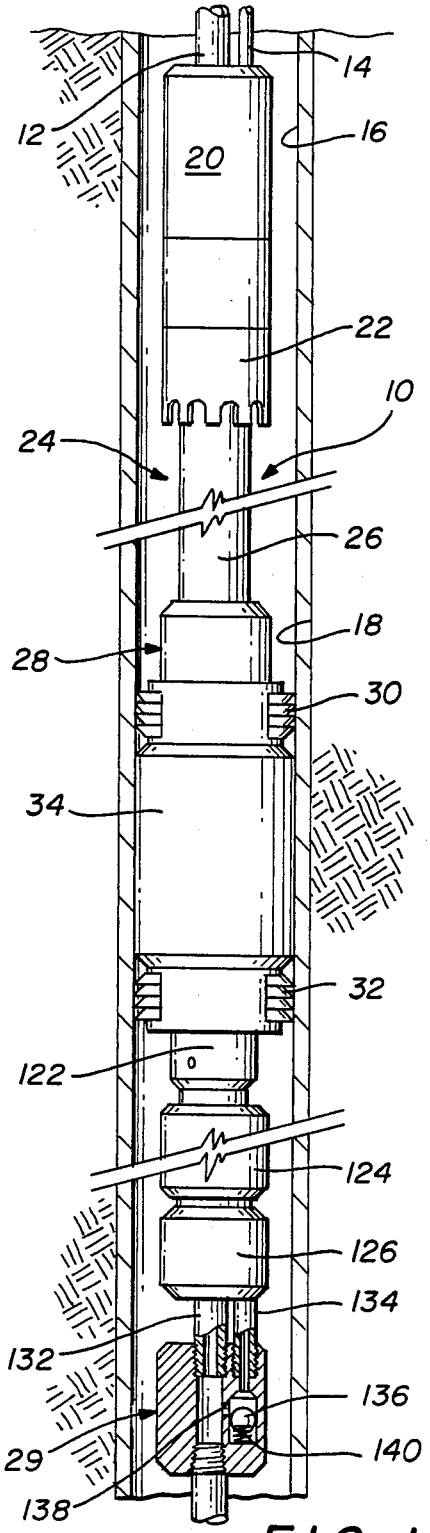
FIG. 1 is a simplified elevation view of apparatus constructed in accordance with the invention located in a well bore.

Referring to the drawing and to FIG. 1 in particular, shown therein and generally designated by the reference character 10 is well treating apparatus that is constructed in accordance with the invention. As illustrated therein, the apparatus 10 is connected to the lower end of parallel well tubing 12 and 14 which is located in a casing 16 disposed in a well bore 18.

The tool or apparatus 10 includes an on/off or releasable connection tool that is generally designated by the reference character 20 which has its upper end connected to the tubing 12 and 14 and has a lower end 22 that includes an overshot mill shoe. The lower end 22 of the tool 20 is arranged to be connected to a valve assembly that is generally designated by the reference character 24. The valve assembly 24 is connected at its lower end 26 with the upper end of a well packer assembly that is generally designated by the reference character 28. The apparatus 10 also includes a cross-over check valve assembly 29 that is connected to the packer assembly 28.

The well packer assembly 28 includes a plurality of upper and lower slips 30 and 32 located adjacent to the top and bottom ends, respectively, of a deformable packing element 34. The packing element 34 is illustrated as being deformed outwardly into sealing engagement with the interior of the casing 16. As shown, the packer assembly 28 isolates the lower portion of the well bore 18 below the packer assembly 28 from the well bore 18 above the packer assembly 28.

FIGS. 2A–2F taken together constitute a more detailed view of the various components of the apparatus 10 with the exception of the packer assembly 28 which is shown only schematically therein. However, the portions of the packer assembly 28 that are pertinent to the invention are shown in detail therein.

Figure 2A:
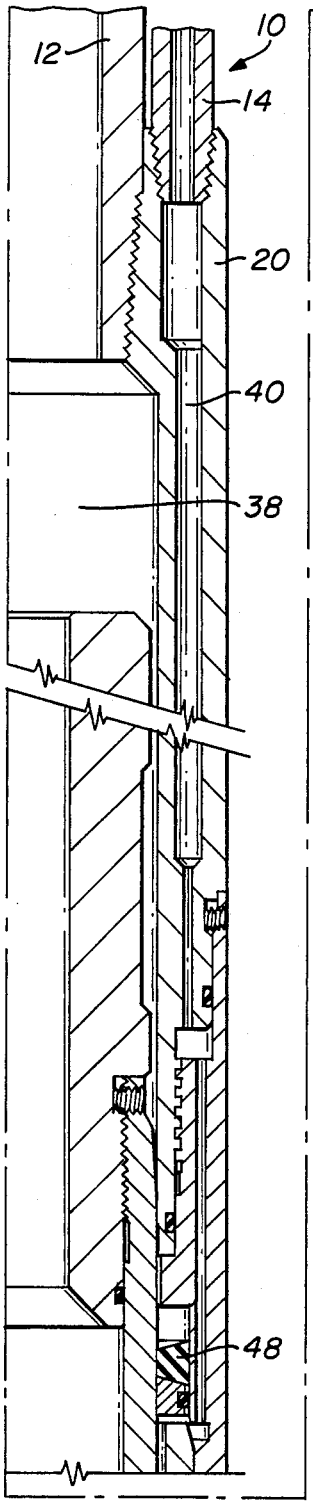
FIG. 2A–2F taken together comprise an enlarged longitudinal cross-section of the apparatus of FIG. 1.

As shown in FIG. 2A, the well tubing 12 is connected with the on/off tool 20 so that it is in fluid communication with a bore 38 that extends through the on/off tool 20. Similarly, the well tubing 14 is connected with the on/off tool 20 so that fluid communication is established between the interior of the tubing 14 and a passageway 40 that extends through the on/off tool 20.

Figure 2B:
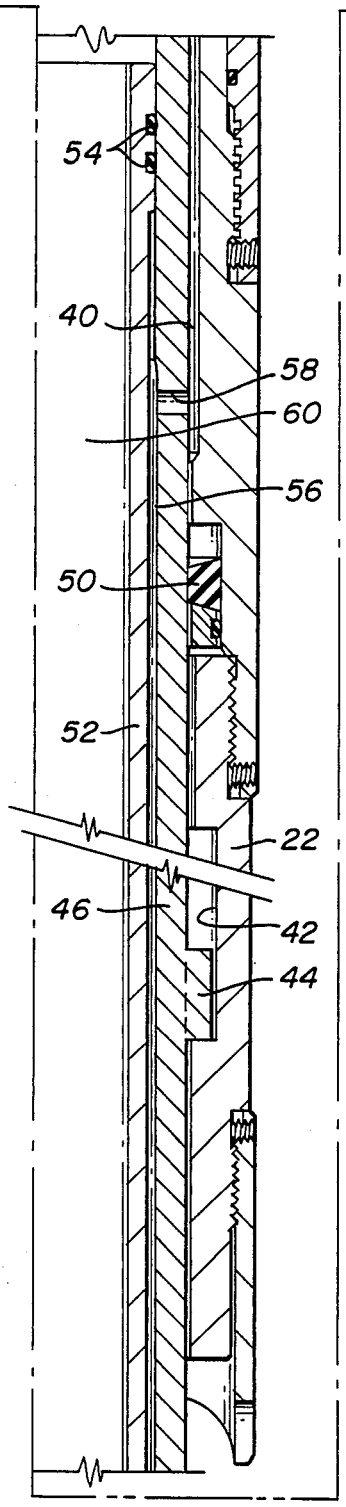
Figure 2C:
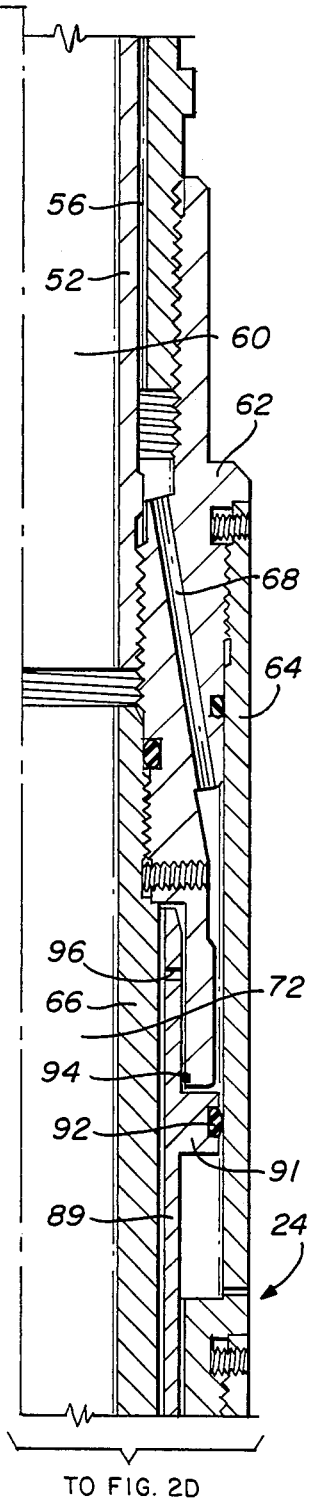

At the lower end of the on/off tool 22 (see FIG. 2B), there is provided a J-slot 42 (see also FIG. 3) that is designed to receive a gudgeon 44 that is carried by a landing nipple 46 which projects upwardly from the valve assembly 24 shown in FIG. 2B, C and D into the on/off tool 20. It will also be noted that an upper seal 48 and a lower seal 50 spaced from the upper seal 48 are carried by the on/off tool 22 and are arranged to form a fluid-tight seal with the exterior of the landing nipple 46.

An inner tube 52 extends concentrically upwardly within the nipple 46 with its upper end being provided with seals 54 to form a generally concentric annular bore 56 between the inner tube 52 and the landing nipple 46. The arrangement is such that fluid flowing through the passageway 40 enters the port 58 connecting the passageway 40 with the concentric annular space 56 between the landing nipple 46 and the inner tube 52. It will also be noted that the inner tube 52 provides a main or inner bore 60 that is in fluid communication with the bore 38 extending through the on/off tool 20.

Figure 3:
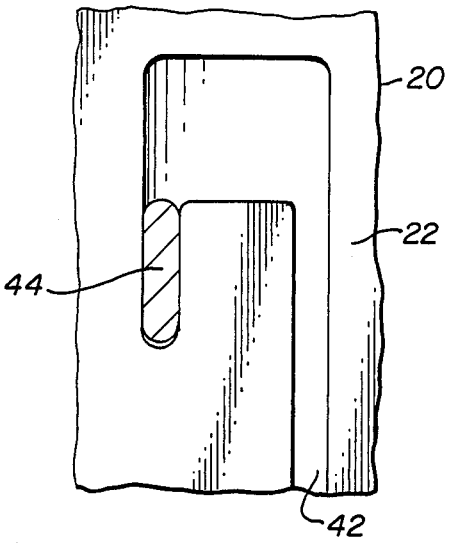
FIG. 3 is an enlarged elevation of a portion of apparatus showing the J-slot connection.

As shown most clearly in FIG. 3, the J-slot 42 is arranged so that the gudgeon 44 can, upon relative axial movement between the gudgeon 44 and the on/off tool 20, move upwardly and then upon rotation between the gudgeon 44 and the on/off tool 20 move into the elongated portion of the J-slot 42. Upon reaching this position, the tubing 12, 14 and the on/off tool 20 can be pulled upwardly and removed from the remainder of the apparatus.

A transition member 62 (see FIG. 2C) connects the landing nipple 46 and the lower end of the inner tube 52 with an outer valve body member 64 and with a concentric upper valve seat member 66. A plurality of passageways 68 extend through the transition member 62 connecting the passageway 56 with an annular space 70 formed between the members 64 and 66. The seat member 66 provides an inner bore 72 that is in fluid communication with the bore 60 extending through the inner tube 52.

Figure 5:
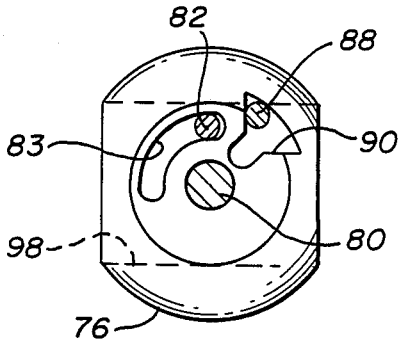
FIG. 5 is an enlarged side view, partly in elevation and partly in cross-section of a valve member used in the valve in the position shown in FIG. 2A–2F.
Figure 6:
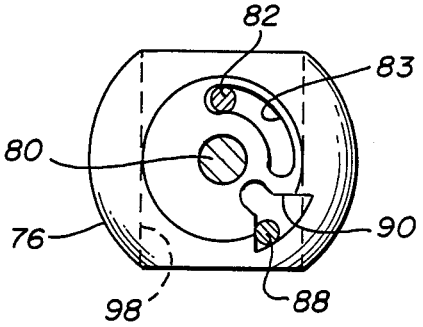
FIG. 6 is an enlarged side view, partly in elevation and partly in cross-section of a valve member used in the valve in the position shown in FIG. 4A–4C.
Figure 2D:
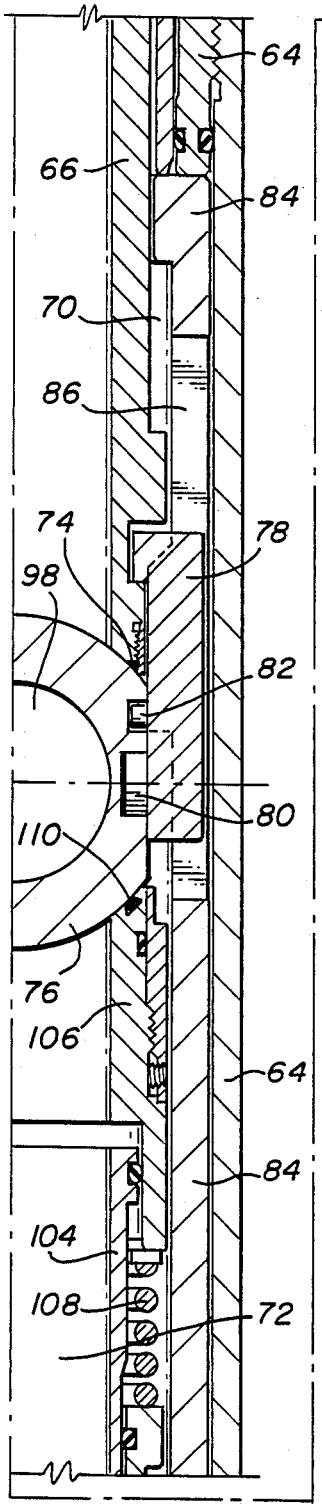

At its lower end, the valve seat member 66 carries an annular seal 74 as shown in FIG. 2D that is in sealing engagement with the exterior of a valve member 76 which is illustrated as being generally spherical in configuration. The valve member 76 is located in the passageway 72 and is pivotally supported therein by a valve support member 78 which carries a pivot pin 80 and a stop pin 82 thereon. The stop pin 82 operates in an arcuate stop slot 83 in the valve member 76 as shown in FIGS. 5 and 6.

The valve support member 78 is disposed in the annular space 70 between the members 64 and 66. It will be noted that the support member 78 does not fill the entire annular space thus leaving room for fluid to flow thereby in the space 70.

While only half of the tool is illustrated, it will be understood that the valve member 76 is preferably symmetrical in configuration and that there will be a second valve support member 78 (not shown) on the opposite side of the valve member 76.

Slidingly disposed in the space 70 is a valve operating member 84 having slot 86 therein for receiving the valve support member 78. The valve operating member 84 includes a lug 88 which shown in dotted lines in FIG. 4B and shown cross-hatched in FIGS. 4 and 5. The lug 88 is located in a triangular shaped slot 90 formed in the valve member 76 so that longitudinal movement of the valve operating member 84 engages the sides of the slot 90 causing the valve member 76 to rotate 90°, that is, from the closed to the open position and vice versa.

Located for sliding movement in the space 70 between the members 64 and 66 is a flow control member 89 (see FIG. 2C) which has an annular piston portion 91 extending radially outwardly therefrom. An O-ring seal 92 is carried in the piston portion 91 forming a sliding seal with the member 64. An O-ring seal 94 is located in the lower end of the transition member 62 and slidingly and sealingly engages the exterior of the flow control member 89.

At its lower end, the member 89 is in engagement with the upper end of the valve operating member 84. Near the upper end of the member 89 is a flow port 96.

The flow port 96 may be a plurality of ports and the size and flow area thereof are determined by the amount of treating fluid that is to flow through the tool. In the position illustrated in FIG. 2C, fluid cannot flow between the members 64 and 66, past the member 89 and through the port 96 due to the location of the seals 92 and 94.

As shown in FIG. 2D, the valve member 76 is in the closed position. It will be noted that a bore 98 extending through the valve member 76 is disposed at right angles or perpendicularly to the axis of the passageway 72 extending through the member 66. Thus, the valve as illustrated in FIG. 2D is in the closed position preventing flow through the passageway 72.

Figure 2E:
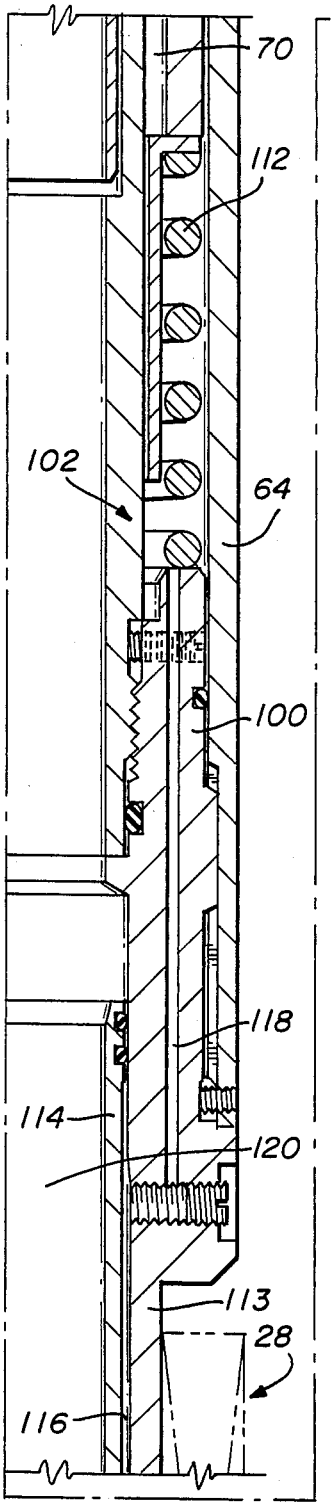

As shown in FIG. 2E, the lower end of the member 64 is connected to a transition portion 100 of an outer packer mandrel 113. Also connected to the transition portion 100 is a lower seat assembly 102. The lower seat assembly 102 includes a piston 104, a valve seat member 106, and a spring 108 that biases the valve seat member 106 toward the valve member 76. The upper end of the valve seat member 106 carries an annular seal 110 that is in sealing engagement with the exterior of the valve member 76. It will be noted that various of the members comprising the lower seat assembly 102 are provided with sliding seals which are arranged to permit pressure in the bore 72 below the valve member 76 to bias the valve seat member 106 and the seal 110 carried thereby into tight sealing engagement with the exterior of the valve member 76.

The valve member 76 is constantly biased or urged toward the closed position illustrated in FIG. 2D by the valve operating member 84 through the previously described lug 88. The biasing force is provided by a spring 112 (see FIG. 2E) that is located in the space 70. The spring 112 has one end in engagement with the transition portion 100 of the outer packer mandrel 113 of the packer assembly 28.

The packer assembly 28 also includes an inner mandrel 114 that is concentrically arranged with respect to the outer mandrel 113 and forms a flow passageway 116 therebetween. It can be observed that the annular passageway 116 is in fluid communication with the space 70 through a passageway 118 extending through the transition portion 100 of the outer mandrel 113. The inner mandrel 114 also defines a bore or passageway 120 extending therethrough that is in fluid communication with the bore or passageway 72. The passageways 116 and 120 are concentrically arranged due to the configuration of the inner and outer mandrels 114 and 113, respectively.

Figure 2F:
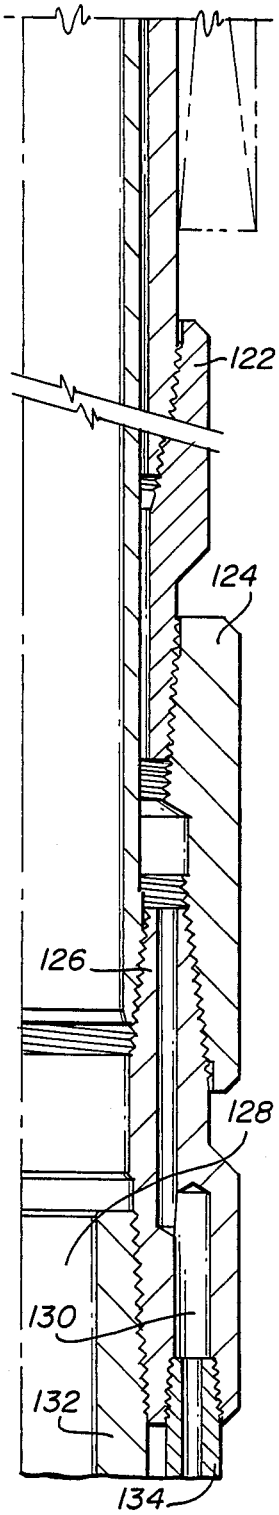

As shown in FIGS. 1 and 2F, the outer mandrel 113 is attached at its lower end to a series of fittings 122, 124 and 126. The fittings are arranged to change the concentric passageways previously described into parallel passageways 128 and 130 and separate but generally parallel tubing members 132 and 134 are attached thereto.

The tubing members 132 and 134 connect the cross-over/check valve assembly 29 to the lower end of the packer assembly 28 as illustrated in FIG. 1. The cross-over/check valve assembly 29 includes a valve member 136 which is arranged to permit and prevent flow through cross-over port 138. The spring 140 is selected to permit flow when the pressure in the passageway 130 exceeds a predetermined value. The port 138 is selected so that treating liquid can flow into the production fluid at a predetermined rate.

OPERATION OF THE PREFERRED EMBODIMENT

With the apparatus 10 assembled as indicated in FIG. 1, the apparatus 10 is extended into the casing 16 in the well bore 18 on the well tubing 12 and 14. After reaching the desired location in the well bore 18, the packer assembly 28 is manipulated appropriately to cause the slips 30 and 32 to set, holding the packer assembly 28 in position in the well bore and deforming the packing element 34 into tight sealing engagement with the casing 16. Thus set, the packer assembly 28 isolates the formations in the well bore above the packer assembly 28 from the formations in the well bore therebelow.

As the apparatus 10 is extended into the well bore, the various components of the valve assembly 24 are in the position illustrated in FIGS. 2A–2F. As illustrated in FIG. 2D, it can be seen that the valve member 76 is in a position closing the passageway 70 extending through the valve assembly 24 and preventing flow of fluid therethrough. Also, the port 96 in the flow control member 89 is located above the O-ring seal 94 preventing flow through the cavity 70, the valve assembly 24, and its interconnected passageways.

It is often desirable when producing oil and/or gas from a well to simultaneously inject some treating material such as a corrosion inhibitor into the production stream to, for example, inhibit the corrosive effect on the well tubing 12 and on well head apparatus (not shown). Accordingly, the inhibitor is pumped downwardly through the well tubing 14, the passageway 40, the passageway 56 through the passageway 68 into the cavity 70 in the valve assembly 24. As the pressure builds up in the cavity in the passageway 68 above the piston 92, the piston 91 and the flow control member 89 are displaced relatively downwardly. Downward movement of the flow control member 89 causes downward movement of the valve operating member 84.

As can be seen in FIG. 5, the lug 88 on the valve operating member 84 is located at the upper side of the recess 90 in the valve member 76. In this position, the valve member 76 is in the closed position as illustrated in FIGS. 2D and 5. Downward movement of the lug 88 initially causes no movement of the valve member 76 since it simply moves across the recess 90. Flow through the cavity 70 is still prohibited at this stage since the port 96 remains above the seal 94.

Figures 4A, 4B, 4C:
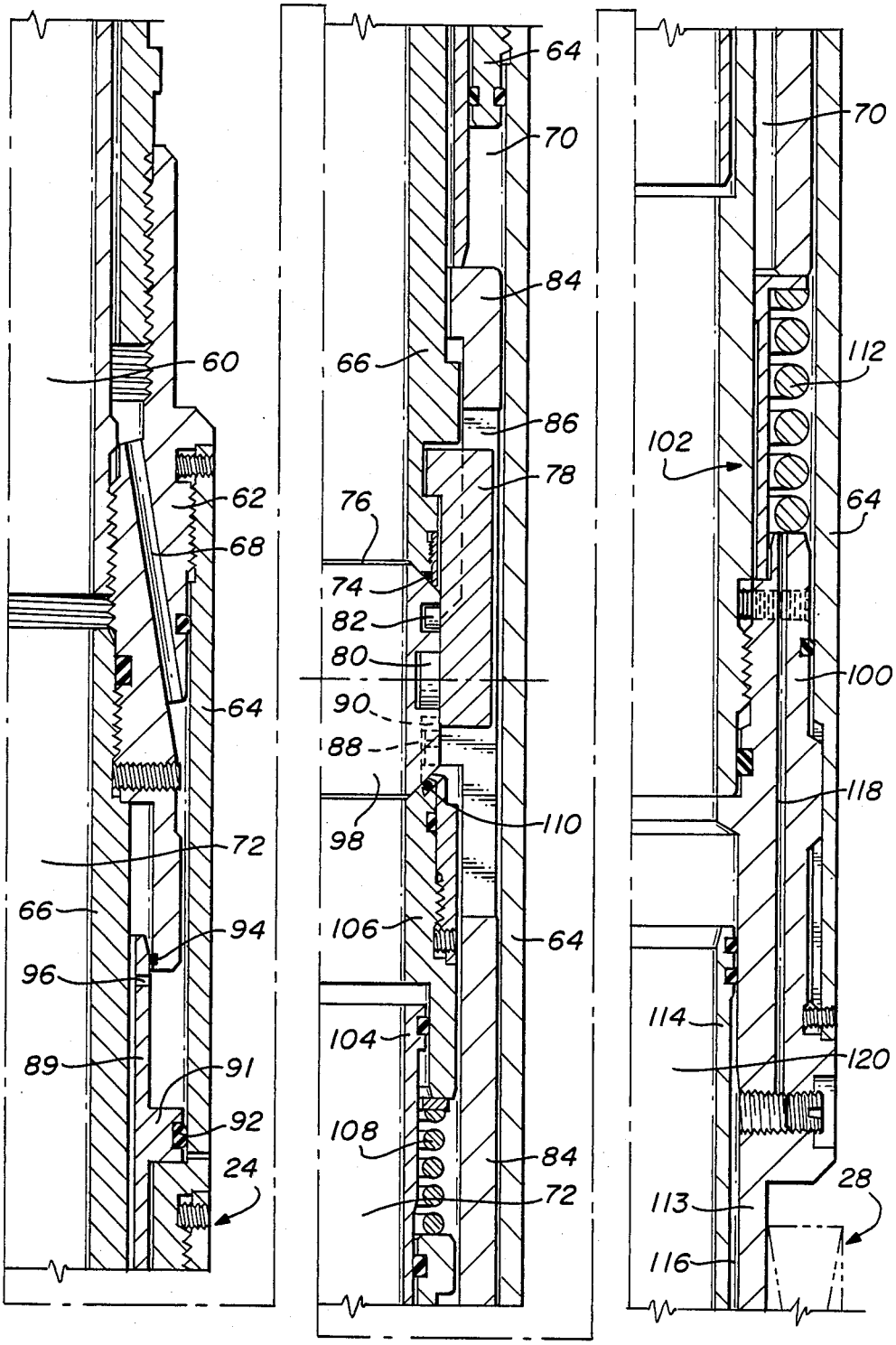
FIGS. 4A–4C taken together comprise a longitudinal cross-section of a valve utilized in the apparatus of 1.

Continued downward movement of the valve operating member 84 and the lug 88 thereon, which is now in engagement with the other side of the recess 90, causes pivotal movement of the valve member 76 about the pivot 80. This position is illustrated in FIGS. 4A–4C and also in FIG. 6. It will be noted that the valve member 76 is limited in the pivotal movement to about 90° by the length of the stop slot 83 in conjunction with the stop pin 82 that is carried by the valve support member 78.

Further downward motion of the valve actuating apparatus is arrested once the valve member 76 reaches the open position illustrated in FIG. 4B in which the bore 98 in the valve member 76 is in alignment with the passageway 72. In this position, the apparatus 10 is open to production of fluid from below the packer assembly 28.

During the opening of the valve member 76, the flow control member 89 has moved downwardly as illustrated in FIG. 4A until the port 96 therein is below the O-ring 94. When this occurs, fluid in the passageway 68 and in the cavity 70 above the piston portion 91 can now communicate with the remainder of the cavity 70 and flow downwardly through the passageway 118 into the annular passageway 116 and the packer assembly 28 and out the tube 134 at the lower end of the apparatus 10 into the cross-over/check valve assembly 29. The size of the port or ports 138 has been carefully determined so that adequate inhibitor or other material will be injected into the production stream. The pressure required to open the ball valve member 136 provides adequate pressure on the piston portion 91 to hold the valve member 76 in the open position.

It will be remembered that the spring 112 is exerting an upwardly directed force on the valve operating member 84 which tends to return the valve member 76 to the closed position illustrated in FIG. 2D. If for any reason the pressure in the cavity 70 decreases, the spring 112 has sufficient force to return the valve member 76 to the closed position, thus stopping production flow. It will be noted in FIG. 5 that the closed position of the valve member 76 is also determined by the relationship between the stop pin 82 and the stop groove 83.

If, for any reason, there is a need to remove the tubing 12 and 14 from the well bore, the tubing 12 and 14 is let down slightly lowering the on/off tool 20 and moving the gudgeon 44 (see FIG. 3) relatively upwardly. The simultaneous rotation of the tubing 12, 14 and the on/off tool 20 aligns the gudgeon 44 with the long open portion 42 of the slot. When this occurs, the well tubing 12 and 14, along with the on/off tool 20 are pulled upwardly, disconnecting those items from the valve assembly 24. Since there is no pressure in the tubing 14, the valve member 76 is returned to the closed position, and thus production from below the packer assembly 28 is shut in upon the removal of the tubing 12 and 14 therefrom.

If it is desired to reattach the tubing 12 and 14 to the remainder of the apparatus 10, the tubing 12 and 14 and the on/off tool 20 are lowered onto the landing nipple 46 until the gudgeon 44 is re-engaged in the J-slot 42. The apparatus is rotated and an upward strain taken on the tubing 12 and 14 to return the gudgeon to the position illustrated in FIG. 3. Pressure may then be applied through the tubing 14 to open the valve member 76 as previously described.

From the foregoing detailed description, it will be understood that well tool apparatus constructed as described provides a means of simultaneously injecting treating material while producing through a packer, automatically closing the packer to production when desired, and closing the packer when the tubing is removed therefrom for the purpose of performing other operations in the well bore.

Having described but a single embodiment of the invention, it will be understood that many changes and modifications can be made thereto without departing from the spirit or scope of the invention.

What is claimed is:

1. An improved dual bore treating tool for use in well bores and the like, the improvement comprising:

elongated valve means having first and second passageways extending longitudinally therethrough, said second passageway having a portion encircling said first passageway;

annular valve seat means encircling said first passageway;

a valve member located in said valve means in engagement with said valve seat means and having a bore extending therethrough, said valve member being pivotal between an open position wherein said first passageway is open and a closed position blocking said first passageway;

valve operating means located in said second passageway in engagement with said valve member and responsive to fluid pressure in said second passageway for moving said valve member between said open and closed positions, said operating means including a flow control member having at least one flow port, said flow control member being moveable between a closed position preventing flow through said second passageway and an open position permitting flow through said second passageway and including spring means for holding said valve member in one of said oepn and closed positions when the pressure in said second passageway is below a predetermined value; and, said flow control member has at least one flow port extending laterally therethrough and said valve means forming a sliding seal between said valve means and said flow control member, whereby relative movement between said flow control member and valve means moves said flow port relative to said seal permitting and preventing flow through said flow port and through said second passageway, said flow control member is annular and includes an annular piston portion in sliding and sealing engagement with said valve means, whereby said flow control member moves in response to pressure in said second passageway.

2. The tool of claim 1 wherein said valve operating means also includes a valve actuating member slidingly disposed in said second passageway, said valve actuating member having one end engaging said flow control member, a second end engaging said spring means, and having a projecting lug portion engaging said valve member for causing said valve member to pivot between said open and closed positions upon movement of said valve actuating member.

3. The tool of claim 2 and also including a valve member support and stop means located in said second passageway and supported against movement by said valve means and having pivot pin portions for providing a pivot for said valve member and carrying at least one stop pin engaging said valve member for limiting the pivotal movement of said valve member.

4. The tool of claim 3 wherein said valve member is generally spherical.

5. Apparatus for use in well bores and the like comprising in combination:

a well packet arranged to be set in a well bore, said packer having generally concentric bores extending therethrough;

valve means connected to said packet including first and second passageways extending therethrough for connection with said concentric bores, said valve means also including a valve member pivotally located for opening and closing said first passageway, valve operating means responsive to pressure in said second passageway for pivoting said valve member, and spring means biasing said valve member toward a position opening or closing said first passageway, said second passageway having a portion encircling said first passageway;

releasable connection means having one end arranged for connection with well tubing whereby said apparatus can be extended into said well bore, another end arranged for releasable connection to said valve means whereby said connection means and tubing can be disconnected from said packer and valve means leaving said packer and valve means in said well bore and whereby said tubing and connection means can be reconnected with said valve means, and a pair of bores in said connection means connected with said passageways in said valve means when said connection means is connected to said valve means;

said valve operating means includes a flow control member having at least one flow port extending laterally therethrough, a flow control portion adjacent to said flow control member, and a sliding seal between said flow control portion and said flow control member, wherby relative movement between said flow control member and valve means moves said flow port relative to said seal permitting and preventing flow through said flow port and through said second passageway; and said flow control member is annular and includes an annular piston portion in sliding and sealing engagement with said enlongated member, whereby said flow control member moves in response to pressure in said second passageway.

6. The apparatus of claim 5 wherein said valve operating means also includes a valve actuating member slidingly disposed in said second passageway, said valve actuating member having one end engaging said flow control member, a second end engaging said spring means, and having a projecting lug portion engaging said valve member for causing said valve member to open and close said first passageway upon movement of said valve actuating member.

7. The apparatus of claim 5 and also including crossover and control valve means including:

a body having a flow passageway therein in communication with said first passageway and having a valve cavity therein in communication with said second passageway, and a port connecting said cavity and flow passageway;

a valve member located in said cavity for permitting and preventing flow through said port; and spring means biasing said valve member to the position preventing flow through said port.

8. The apparatus of claim 7 wherein said spring means is guidable at a pressure adequate to displace said flow control member opening said first mentioned valve member.

9. The apparatus of claim 7 wherein said last mentioned port is sized to permit the desired flow rate between said cavity and first passageway.

10. Apparatus for use in well bores and the like comprising in combination:

a well packer arranged to be set in a well bore, said packer having generally concentric bores extending therethrough;

valve means connected to said packet including first and second passageways extending therethrough for connection with said concentric bores, said valve means also including a valve member pivotally located for opening and closing said first passageway, valve operating means responsive to pressure in said second passageway for pivoting said valve member, and spring means biasing said valve member toward a position opening or closing said first passageway, said second passageway having a portion encircling said first passageway;

releasable connection means having one end arranged for connection with well tubing whereby said apparatus can be extended into said well bore, another end arranged for selective releasable connection to said valve means whereby said connection means and tubing can be disconnected from said packer and valve means leaving said packer and valve means in said well bore and whereby said tubing and connection means can be reconnected with said valve means, and a pair of bores in said connection means connected with said passageways in said valve means when said connection means is connected to said valve means; and, said valve operating means includes a flow control member having at least one flow port extending laterally therethrough, a flow control portion adjacent to said flow control member, and a sliding seal between said flow control portion and said flow control member, whereby relative movement between said flow control member and valve means moves said flow port relative to said seal permitting and preventing flow through said flow port and through said second passageway.

* * * * *

UNITED STATES PATENT AND TRADEMARK OFFICE

CERTIFICATE OF CORRECTION

PATENT NO. : 4,749,036

DATED : June 7, 1988

INVENTOR(S) : Norman W. Read

It is certified that error appears in the above-identified patent and that said Letters Patent is hereby corrected as shown below:

In column 2, line 12, change "1." to -- Fig. 1 --.

In column 7, line 66, change "packet" to -- packer --.

In column 9, line 4, change "packet" to -- packer --.

Signed and Sealed this

Eighth Day of November, 1988

*Attest:*

DONALD J. QUIGG

*Attesting Officer*

*Commissioner of Patents and Trademarks*